United States Patent [19]

Giuffredi

[11] 4,122,982

[45] Oct. 31, 1978

[54] AEROSOL METERING VALVE PROVIDED WITH PUMPING EFFECT

[75] Inventor: Giancarlo Giuffredi, Milan, Italy

[73] Assignee: Coster Tecnologie Speciali S.p.A., Italy

[21] Appl. No.: 775,626

[22] Filed: Mar. 8, 1977

[30] Foreign Application Priority Data

Mar. 16, 1976 [IT] Italy ..... 20983/76[U]

[51] Int. Cl.[2] ..... B67D 5/42

[52] U.S. Cl. ..... 222/321; 222/341; 239/337

[58] Field of Search ..... 222/309, 321, 380, 383–385, 222/401, 402.1, 402.2, 520, 559, 564, 340, 341, 320; 239/333, 337; 417/545–554

[56] References Cited

U.S. PATENT DOCUMENTS

| | | | |
|---|---|---|---|
| 3,211,346 | 10/1965 | Meshberg | 222/309 X |
| 3,257,961 | 6/1966 | Schlenker | 222/321 X |
| 3,414,169 | 12/1968 | Corsette | 222/321 |
| 3,908,870 | 9/1975 | Nozawa et al. | 222/385 X |

*Primary Examiner*—Robert B. Reeves
*Assistant Examiner*—Fred A. Silverberg
*Attorney, Agent, or Firm*—Steinberg & Blake

[57] ABSTRACT

An aerosol metering valve provided with a pumping effect, comprising a first hollow piston movable within a cylinder or chamber housing a second piston movable against a spring and normally urged thereby to a position closing the hollow piston, wherein the second piston has at least one passage which, under inoperative conditions of the valve, provides communication between the interior of the container and the cylinder or chamber.

8 Claims, 4 Drawing Figures

AEROSOL METERING VALVE PROVIDED WITH PUMPING EFFECT

The present invention relates to an aerosol metering valve provided with a pumping effect.

At present, novel propellants for aerosol are being inquired into for replacing the actual halogenated hydrocarbons (freon) used to this purpose. Thus, studies made in the United States would indicate that such halogenated hydrocarbons are harmful. An excellent propellant, that can be used in bottles or similar containers for aerosol, is carbon dioxide, which is a non-toxic gas and has been successfully used for more than 50 years in the food industry. In order to produce an aerosol with $CO_2$, the product to be aerosolized should be saturated at a pressure of at least 6–7 bars to obtain a reasonable aersolizing effect. Thus, at lower pressures the atomizing effect is substantially negligible.

In standard aerosols using halogenated hydrocarbons as a propellant, the pressures within the container are normally in the order of about 3 bars. Obviously, when $CO_2$ is used as a propellant at a pressure of 6–7 bars, it may be dangerous, particularly if the container is a glass.

It is the main object of the invention to provide a metering valve which, by increasing the pressure at the dispensing step to rates of 6–7 bars in one of its parts (and accordingly not in the container), allows the use of $CO_2$ as a propellant at a pressure in the range of 2–3 bars in the container.

According to the invention, the valve, of the type comprising a first hollow piston movable within a cylinder and housing a second piston movable against a spring means, is essentially characterized in that this second piston has at least one passage which, under inoperative conditions of the valve, provides communication between the interior of the container and the cylinder.

The invention can be more clearly understood from the following detailed description, given by mere way of example and in connection with the accompanying drawing, in which.

Figure 1:
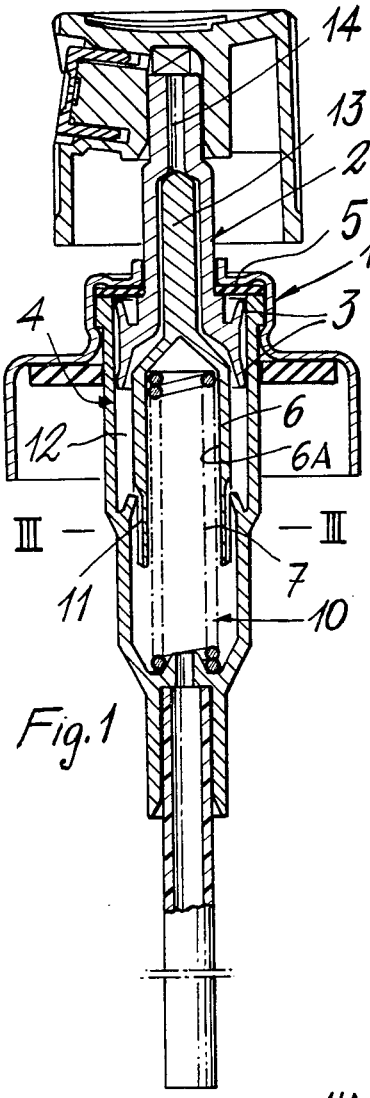
FIG. 1 is an axial sectional view showing the metering valve in a rest condition.
Figure 2:
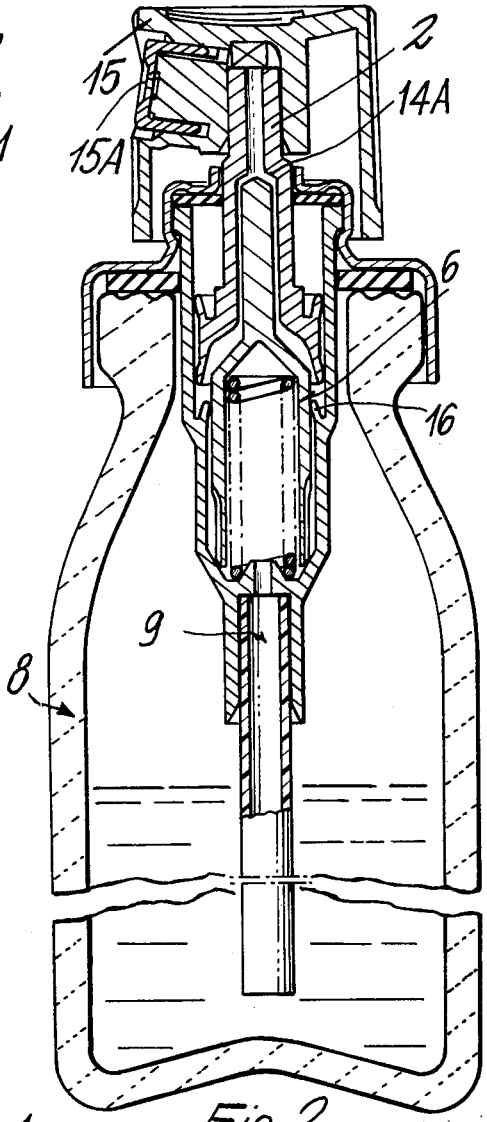
FIG. 2 is an axial sectional view showing the metering valve at the end of the dispensing or pressure stroke.

Referring to the figures of the accompanying drawing, a valve according to the invention comprises a metal bowl or cap 1, by means of which the valve is coupled to a container 8, therein containing the product to be dispensed as saturated with $CO_2$ at a low pressure (about 2 bars).

Said cap 1 has clamped therein the upper outer end of a hollow cylinder 4 with the interposition of a rubber sealing disc 5, having the purpose of providing a seal along the stem of a first or piston rod portion piston 2. This piston 2 is slidably mounted in said cylinder or outer 4, made of plastic material, and has seals 3 integrally made with the piston. Piston 2 is hollow, in that it has in its piston rod portion a bore 14 axially passing therethrough and having an intermediate sealing shoulder 14A. An ordinary aerosol pushbutton 15, provided with a dispensing nozzle 15A connected with said bore 14, is threaded on the stem of piston 2.

Figure 3:
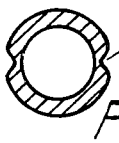
FIG. 3 is a sectional view showing only the internal piston, and taken along line III—III of FIG. 1.
Figure 4:
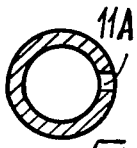
FIG. 4 shows a variant or modification in a sectional view like that of FIG. 3.

With clearance a solid piston rod portion 13 of an inner piston 6 is positioned within said bore 14 and is intended to provide a seal on the shoulder 14A when urged against shoulder 14A by a spring means 7, thus closing the axial bore 14. Said piston rod portion 13 is integral with the remainder of inner piston 6 located internally of the cylinder 4 and the hollow interior of outer piston 2 and therefore having a smaller diameter than the outer piston 2. The inner piston 6 is provided with a blind bore or cavity 6A, against the bottom of which one end of a compression spring means 7 presses, the other end of this spring bearing against an open inner end of cylinder 4 this open inner end of the cylinder 4 thus communicating permanently with the interior of the container 8. At its lower inner end, said second piston 6 is also provided with a passage means formed by a series of outer axial grooves 11 (FIG. 3), but which can be replaced by one or more radial holes 11A (FIG. 4) which, under inoperative or in the rest condition of the valve, are located slightly above an inwardly extending annular sealing projection or ridge 16 on the inner face of cylinder 4 slidably engaging the exterior of the inner piston 6. This projection or ridge 16 is effective as a seal on the periphery or outer surface of the inner piston 6 with the latter dividing the inside of cylinder 4 into a pressure chamber 12 situated above the projection 16 and a lower interior region of cylinder 4, beneath ridge 16, permanently communicating with the interior of the container 8 through the open inner end of the cylinder 4. This latter chamber 12, referred to as a pressure or metering chamber, has said outer piston 2 sealingly sliding therein. The lower inner interior region of the cylinder 4 is connected through a drawing or suction tube 9 with the inside of said container 8.

The valve according to the invention operates as follows. Depression of pushbutton 15 causes also depression of the outer piston 2, as well as that of the inner piston 6, since the latter bears with its solid piston rod portion 13 against shoulder 14A and closes axial bore 14. After a short stroke, the grooves 11 or hole 11A of inner piston 6 pass inwardly beyond the sealing projection or ridge 16, and pressure chamber 12 is isolated or sealed from the container 8 as well. On continued stroke, due to the larger cross-section of the outer piston 2 over that of the inner piston 6, the pressure within the chamber 12 will considerably increase until the liquid pressure is such that, by acting on piston 6, it overcomes the resistance or force of spring 7. Thereby, said piston 6 along with its solid piston rod portion 13 is downwardly displaced, moving away from said outer piston 2. Therefore, the bore 14 is opened and the pressurized liquid reaches said bore and comes out of nozzle 15A in atomized condition.

As soon as the pressure is reduced within chamber 12, under the action of said spring 7 the inner piston 6 moves in the direction towards the outer piston 2, obstructing said bore 14 with the piston rod portion 13.

When the pushbutton 15 is released, the assembly moves back to the position shown in FIG. 1, where the grooves 11 or the holes 11A connect said chamber 12 with the inside of the container 8, so that the liquid flows into said chamber.

Obviously, by varying the diameters of the two pistons 2 and 6 and the load of spring 7, valves can be provided far opening at determined pressures unaffected by the pressure within the container 8.

It will thus be seen that with the structure of the invention the aerosol valve assembly includes the hollow cylinder 4, which is adapted to be fixed to an upper portion of the container 8 the contents of which are to be dispensed. This cylinder 4 has an inner open lower end adapted to communicate permanently with the interior of the container 8. The outer piston 2 is slidable fluid-tightly within the cylinder 4 and has an elongated piston rod portion which extends fluid-tightly through and beyond the outer end of the cylinder 4, this piston rod portion being formed with the axial bore 14 passing therethrough and forming part of a dispensing path of travel for the contents of the container while these contents travel through the axial bore 14 from an inner end toward an outer end thereof. The inner piston 6 is situated within the cylinder 4 between the outer piston 2 and the inner end of the cylinder 4, and spring means 7 within the cylinder 4 urges the inner piston 6 toward the outer piston 2, this inner piston 6 having the elongated solid piston rod portion 13 normally pressed by the spring means 7 against the inner end of the axial bore 14 for normally closing the latter to prevent dispensing of the contents of the container. The inner piston 6 has between the outer piston 2 and the inner end of the cylinder 4 an outer portion in slidable fluid-tight contact with the cylinder 4. The inner piston 6 has between this outer portion thereof which engages the projection 16 and the outer piston 2 an outer surface which is spaced from the outer piston 2 as well as the inner surface of the cylinder 4 so as to define the pressure chamber 12 with the inner surface of the cylinder 4 and the outer piston 2. The spring means 7 of course urges both of the pistons to the rest position illustrated in FIG. 1 where the outer piston 2 is distant from the inner end of the cylinder while the inner piston 6 is maintained by the spring means 7 in a closed position closing the axial bore 14. The inner piston 6 has the passage means 11, 11A which places the interior portion of the cylinder 4 at the region of its inner end, and thus the interior of the container, in communication with the pressure chamber 12 when the pistons are in their rest position, while preventing communication between this interior portion of the cylinder 4 and the pressure chamber when the pistons are both manually displaced toward the inner end of the cylinder in opposition to the spring means 7 during a pressure stroke applied to the outer piston and through the latter to the inner piston for dispensing the contents of the container through the axial bore 14. The inner piston has in the pressure chamber 12 in a plane normal to the axis of the bore 14 a cross-sectional area at the outer surface of the inner piston 6 great enough to provide from the increasing pressure of the fluid in the pressure chamber 12 during the pressure stroke of the pistons a force sufficient to advance the inner piston 6 automatically in opposition to the spring means 7 inwardly beyond the outer piston 2 for opening the axial bore 14 and to thus provide for automatic dispensing of the contents of the container when the pressure in the pressure chamber has increased sufficiently. In this way the contents of the container will be dispensed at a pressure greater than that prevailing in the interior of the container.

What is claimed is:

1. In an aerosol valve assembly, a hollow cylinder adapted to be fixed to an upper portion of a container the contents of which are to be dispensed, said cylinder having an inner open end adapted to communicate permanently with the interior of the container, an outer piston slidable fluid-tightly in said cylinder and having an elongated piston rod portion extending fluid-tightly through and beyond an outer end of said cylinder, said piston rod portion being formed with an axial bore passing therethrough and forming part of a dispensing path of travel for the contents of the container while said contents travel through said axial bore from an inner end toward an outer end thereof, an inner piston situated in said cylinder between said outer piston and said inner end of said cylinder, and spring means in said cylinder urging said inner piston toward said outer piston, said inner piston having an elongated solid piston rod portion normally pressed by said spring means against said inner end of said axial bore for normally closing the latter to prevent dispensing of the contents of said container, said inner piston having between said outer piston and said inner end of said cylinder an outer portion in slidable fluid-tight contact with said cylinder, and said inner piston having between said outer portion thereof and said outer piston an outer surface spaced from said outer piston and an inner surface of said cylinder to define a pressure chamber with said inner surface of said cylinder and said outer piston, said spring means urging both of said pistons to a rest position where said outer piston is distant from said inner end of said cylinder while said inner piston is maintained by said spring means in a closed position closing said axial bore, said inner piston having a passage means placing an interior portion of said cylinder at the region of said inner end thereof, and thus the interior of said container, in communication with said pressure chamber when said pistons are in said rest position thereof but preventing communication between said interior portion of said cylinder and said pressure chamber when said pistons are both manually displaced toward said inner end of said cylinder in opposition to said spring means during a pressure stroke applied to said outer piston and through the latter to said inner piston for dispensing the contents of the container through said axial bore, said inner piston having in said pressure chamber in a plane normal to the axis of said bore a cross-sectional area at the outer surface of said inner piston great enough to provide from the incresing pressure of the fluid in said pressure chamber during the pressure stroke of said pistons a force sufficient to advance said inner piston automatically in opposition to said spring means inwardly beyond said outer piston for opening said axial bore to provide for automatic dispensing of the contents of the container when the pressure in said pressure chamber has increased sufficiently, whereby the contents of the container will be dispensed at a pressure greater than that prevailing in the interior of the container.

2. The combination of claim 1 and wherein said spring means is in the form of a compression spring situated between said inner end of said cylinder and said inner piston.

3. The combination of claim 1 and wherein said cylinder has an interior inwardly extending annular projection with which said outer portion of said inner piston is in slidable fluid-tight engagement.

4. The combination of claim 3 and wherein said passage means is in the form of an outer surface region of said inner piston which is formed with at least one axial groove extending across and beyond said annular projection of said cylinder in the rest position of said inner piston while situated inwardly beyond said projection during said pressure stroke.

5. The combination of claim 3 and wherein said inner piston has a hollow portion the outer surface of which is in slidable fluid-tight engagment with said projection of said cylinder, and said hollow portion of said inner piston being defined in part by a wall formed with an opening passing therethrough and forming said passage means, said opening being situated in communication with said pressure chamber in the rest position of said inner piston while being situated inwardly beyond said projection during the pressure stroke of said inner piston.

6. The combination of claim 1 and wherein said piston rod portion of said outer piston has an outer elongated section formed with said axial bore and an inner elongated section forming an extension of said outer section and having a greater diameter than said outer section, said inner elongated section being formed with an interior bore of a larger diameter than said axial bore and joined thereto at an inner shoulder of said piston rod portion of said outer piston, said piston rod portion of said inner piston extending with clearance along the interior of said bore of said inner section of said piston rod portion of said outer piston and terminating in an outer end engaging said shoulder for closing said axial bore at said inner end thereof.

7. The combination of claim 6 and wherein said inner piston has inwardly beyond said elongated solid piston rod portion thereof an elongated piston portion of a larger diameter than said piston rod portion of said inner piston.

8. The combination of claim 7 and wherein said outer piston has facing said inner end of said cylinder a hollow interior portion receiving part of said inner piston which is adjacent but beyond said solid piston rod portion thereof while when said inner piston closes said axial bore said inner piston is spaced from said outer piston except for engaging the inner end of said axial bore.

* * * * *